United States Patent [19]

Takahashi et al.

[11] Patent Number: 4,467,622

[45] Date of Patent: Aug. 28, 1984

[54] AUGER-TYPE ICEMAKER

[75] Inventors: Shigeyuki Takahashi, Ota; Nobuyuki Yoshida, Ora; Masahiro Kobayashi, Ota, all of Japan

[73] Assignee: Sanyo Electric Co., Ltd., Japan

[21] Appl. No.: 418,192

[22] Filed: Sep. 15, 1982

[30] Foreign Application Priority Data

Sep. 18, 1981 [JP] Japan ..... 56-139530[U]
Sep. 18, 1981 [JP] Japan ..... 56-139531[U]
Aug. 9, 1982 [JP] Japan ..... 57-138837

[51] Int. Cl.[3] ..... F25C 5/14

[52] U.S. Cl. ..... 62/354; 264/123; 425/380

[58] Field of Search ..... 62/354; 100/117; 425/206-208, 380; 264/109, 123

[56] References Cited

U.S. PATENT DOCUMENTS 3,196,628 7/1965 Reynolds ..... 62/354 X
3,220,215 11/1965 Pichler ..... 62/354
3,276,223 10/1966 Lunde ..... 62/354 X
3,342,040 9/1967 Dedricks et al. ..... 62/354 X
3,593,539 7/1971 Fiedler ..... 62/354
3,595,162 7/1971 Heinrich ..... 100/117 X
4,250,718 2/1981 Brantley ..... 62/354

*Primary Examiner*—William E. Tapolcai
*Attorney, Agent, or Firm*—Darby & Darby

[57] ABSTRACT

An auger-type icemaker for producing hard chip ice of high quality comprises a refrigerated cylinder for forming ice grown on an inner wall surface thereof, a scraper auger rotatably mounted in the refrigerated cylinder for scraping off the ice on the inner wall surface of the refrigerated cylinder, and upper and lower bearing by which said scraper auger is rotatably supported in the refrigerated cylinder. The upper bearing has standard peripheral surfaces and a plurality of axial ribs projecting radially outwardly from the standard peripheral surfaces into abutment against the inner wall surface of the refrigerated cylinder. The standard surfaces include slant surfaces extending upwardly and radially outwardly progressively toward the inner wall surface of the refrigerated cylinder, and parallel surfaces extending upwardly contiguously from the slant surface and substantially parallel to the inner wall surface of the refrigerated cylinder.

13 Claims, 9 Drawing Figures

AUGER-TYPE ICEMAKER

BACKGROUND OF THE INVENTION

The present invention relates to an auger-type icemaker for making chip ice by rotating a scraper auger to scrape off ice grown on an inner wall surface of a refrigerated cylinder and compressing the scraped ice in passages defined between an upper bearing for the scraper auger and the refrigerated cylinder, and more particularly to a construction of such an upper bearing.

Auger-type icemakers generally include a refrigerated cylinder having an inner wall surface for growing ice thereon and an upper bearing supporting an auger rotatably in the refrigerated cylinder and having peripheral surfaces extending parallel to or spaced at a constant width from the inner wall surface, the peripheral surfaces serving as portions of passages for compressing ice as it is fed by the auger. Such auger-type icemakers are disclosed in U.S. Pat. No. 3,372,558 and Japanese Patent Publication No. 40-3876. The known auger-type icemaker however is disadvantageous in that scraped ice cannot be compressed sufficiently and no hard chip ice of high quality can be produced. According to a recent proposal, leaf springs are mounted on the upper bearing to render the ice compression passages progressively smaller upwardly (see Published unexamined Utility Model Application No. 54-101651, for example). However, such an arrangement is complex in structure and the leaf springs tend to be deformed or broken.

SUMMARY OF THE INVENTION

It is an object of the present invention to provide an auger-type icemaker for manufacturing high-quality ice chips which are hard, substantially crackless, and have uniform shapes.

Another object of the present invention is to provide an auger-type icemaker which can operate stably for making ice chips by preventing excess cooling within a refrigerated cylinder.

According to the present invention, there is provided an auger-type icemaker for producing high quality ice chips which are hard, the icemaker comprising a refrigerated cylinder for forming ice grown on an inner wall surface thereof, a scraper auger for scraping off the ice on the inner wall surface of the refrigerated cylinder, and upper and lower bearings by which the scraper auger is rotatably supported in the refrigerated cylinder, the upper bearing having standard peripheral surfaces and a plurality of axial ribs projecting radially outwardly from the standard peripheral surfaces into abutment against the inner wall surface of the refrigerated cylinder, the standard surfaces including slant surfaces extending upwardly and radially outwardly progressively toward the inner wall surface of the refrigerated cylinder, and parallel surfaces extending upwardly contiguously from the slant surface and spaced a substantially constant distance from the inner wall surface of the refrigerated cylinder the standard peripheral surfaces, the axial ribs and the inner wall surface jointly constituting passages for compressing the ice therein which has been scraped off by the scraper auger to form ice chips at the upper open end of the refrigerated cylinder.

With the standard peripheral surfaces of the upper bearing being composed of the slant and parallel surfaces, the ice compression passages of a particular shape are defined between the upper bearing and the inner wall surface of the refrigerated cylinder for gradually compressing scraped ice under a strong compressive force at the slant surfaces and shaping hardened ice at the parallel surfaces, so that substantially crackless ice chips of high quality can be produced.

The slant surfaces are preferably inclined at an angle which ranges from about 4 to 10 degrees, and the ratio of the length or height thereof to that of the parallel surfaces up to the upper open end of the refrigerated cylinder is preferably in the range of from about 8 to 10 mm. The slant and parallel surfaces are preferably curved or flat.

The standard peripheral surfaces of the upper bearing include recesses extending upwardly contiguously from the parallel surfaces, and the upper open end of the refrigerated cylinder is positioned slightly above upper ends of the refrigerated cylinder. With this arrangement, ice bars as they emerge from the compression passages are prevented from being broken especially at their corners when the ice bars are sheared into predetermined lengths. Therefore, ice chips of high quality can be produced.

The recesses are preferably in the form of curved or flat recesses which are about 1 to 5 mm deep. The recesses are contiguously defined between the parallel surfaces and an ice shearing edge or projection.

The standard peripheral surfaces or sides of the axial ribs have air escape grooves extending substantially parallel to the compression passages and having upper ends communicating with the exterior of the compression passages. The air escape grooves serve to prevent the interior of the refrigerated cylinder from being excessively cooled and hence to allow the auger-type icemaker to operate stably for the making of ice. More specifically, air bubbles released from scraped ice are discharged out to thereby allow the refrigerated cylinder to cool scraped ice sufficiently without interruption which would otherwise be caused by air bubbles trapped in the refrigerated cylinder. Ice layers grown on the inner wall surface of the refrigerated cylinder are thus prevented from being cooled excessively. Ice chips can be stably produced without imposing undue loads on the scraper auger.

The air escape grooves are preferably of a width ranging from about 1 to 3 mm and a depth ranging from about 1.5 to 3.5 mm so that ice chips as formed will be substantially free from any mark of the air escape grooves. Where the standard peripheral surfaces have the recesses, no air escape grooves may be provided in the recesses.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
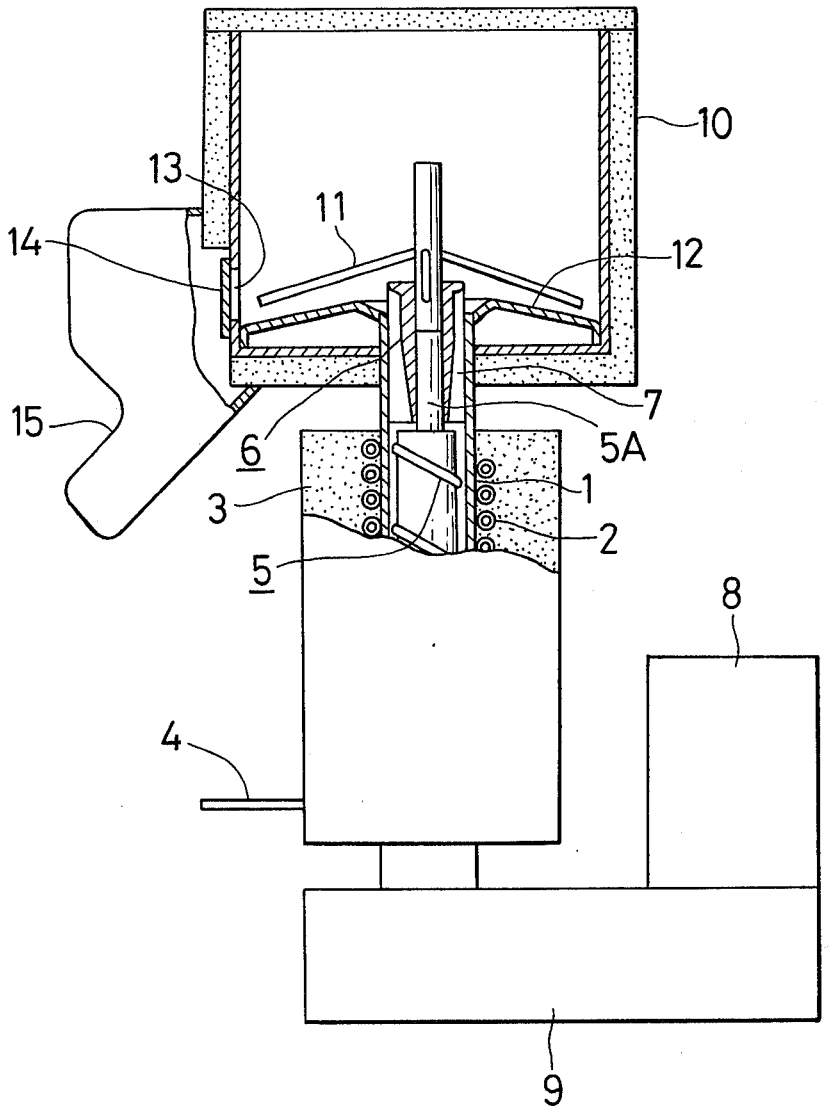
FIG. 1 is an elevational view, partly in cross section, of an auger-type icemaker according to an embodiment of the present invention.

FIG. 1 shows an ice dispenser in which the present invention is incorporated. The ice dispenser has a refrigerated cylinder 1 surrounded by a refrigerant evaporation tube 2 and housed in a thermally insulating wall 3. The ice dispenser also has a water supply tube 4 for supplying water into the refrigerated cylinder 1 up to a certain level, an ice scraper auger 5 rotatably mounted in the refrigerated cylinder 1, an upper bearing 6 supporting an upper shaft 5A of the auger 5, there being compression passages 7 defined between an outer periphery of the upper bearing 6 and an inner wall surface of the refrigerated cylinder 1. The auger 5 is drivable by a driving motor 8 through a speed reducer mechanism (not shown) housed in a casing 9. An ice storage hopper 10 is mounted on an upper end of the refrigerated cylinder 1 and communicates with an upper end opening thereof. An ice discharge member 11 is connected to the upper shaft 5A of the auger 5 and disposed in the ice storage hopper 10. The ice storage hopper 10 contains therein a conical drain board 12 is mounted on the bottom of the ice storage hopper 10. The ice storage hopper 10 has a side ice outlet 13 opening in a lower portion of the ice storage hopper 10. The side ice outlet 13 can be opened and closed by an electrically controlled shutter or cover 14. Ice chunks or chips produced can be dispensed from the ice storage hopper 10 through the side ice outlet 13 into a chute 15 attached to the ice storage hopper 10.

Figure 2:
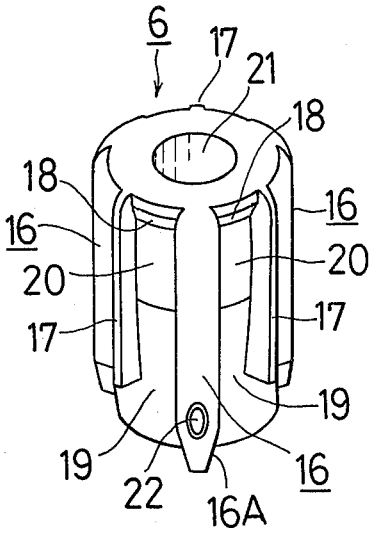
FIG. 2 is a perspective view of an upper bearing in the auger-type icemaker.

The compression passages 7 are of an improved construction according to the present invention and will be described in detail with reference to FIG. 2. The upper bearing 6 has standard peripheral surfaces (hereinafter referred to as "peripheral surfaces"), and three long thick axial compression ribs 16 (hereinafter referred to as "compression ribs") projecting radially outwardly from the peripheral surfaces at angularly equally spaced locations and having tapered lower side surfaces 16A, and three short thin compression ribs 17 each interposed circumferentially between adjacent two of the compression ribs 16. The upper bearing 6 has an ice shearing peripheral edge 18 on its upper end. The compression ribs 16, 17 and the ice shearing peripheral edge 18 are integral with the upper bearing 6. The upper bearing 6 also has lower slant surfaces 19 and upper contiguous parallel surfaces 20 extending up to the ice shearing edge 18 and spaced a constant distance from the inner wall surface of the refrigerated cylinder 1.

The upper bearing 6 has a central hole 21 in which the upper shaft 5A of the auger 5 is supported. The upper bearing 6 is fastened to the refrigerated cylinder 1 by screws (not shown) extending threadedly through threaded holes 22 in the compression ribs 16 against the upper shaft 5A. With the upper bearing 6 thus attached, the compression ribs 16, 17 have radially outward surfaces held against the inner wall surface of the refrigerated cylinder 1, and the compression passages 7 are defined between the inner wall surface of the refrigerated cylinder 1, the adjacent compression ribs 16, 17, the slant surfaces 19, and the parallel surfaces 20, the compression passages 7 being six in number. Each of the compression passages 7 includes a lower ice compression passageway 7A defined between the slant surface 19 and the inner wall surface of the cylinder 1 and becoming progressively narrower upwardly and an upper ice guide passageway 7B defined between the parallel surface 20 and the inner wall surface of the cylinder 1 and having a constant width up to an upper end opening of the compression passage 7. Although the slant surfaces 19 and parallel surfaces 20 are arcuate in shape, they may be flat throughout.

Figure 3:
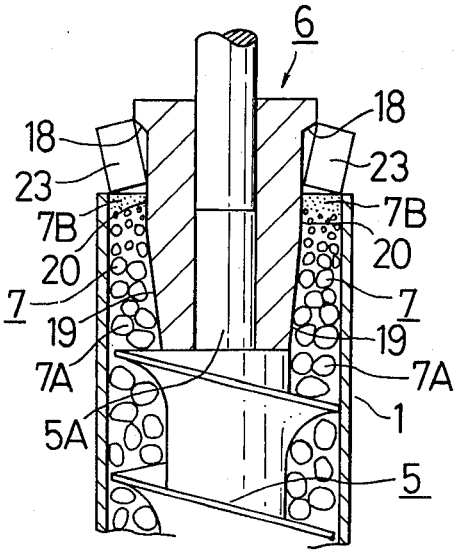
FIG. 3 is a fragmentary cross-sectional view of the upper bearing, showing the manner in which the upper bearing operates.

Operation of the ice dispenser to produce ice chips or chunks will be described. As shown in FIG. 3, slush ice grown on the inner wall surface of the refrigerated cylinder 1 is scraped off and fed upwardly by the auger 5 into the ice compression passageways 7A in which slush ice is compressed and almost all water is removed. Then, the ice as compressed enters the ice guide passageways 7B in which the ice is orderly arranged. The ice as it emerges from the ice guide passageways 7B moves upwardly in the form of ice bars and is brought against the ice shearing edge 18. Upon hitting the ice shearing edge 18, the ice bars are subjected to radially outward forces and broken at the open edge of the refrigerated cylinder 1 into substantially crackless neatly shaped ice chips or chunks 23 of a given shape which are then fed into the ice storage hopper 10.

Figure 4:
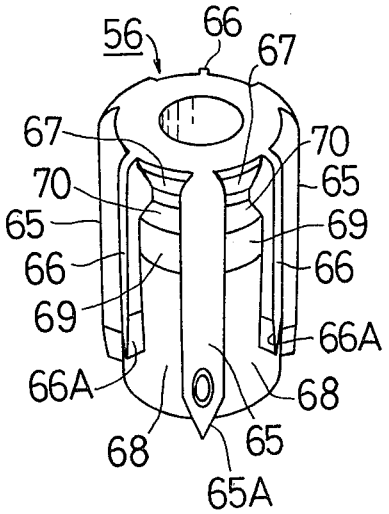
FIG. 4 is a view similar to FIG. 2, showing an upper bearing according to another embodiment.
Figure 5:
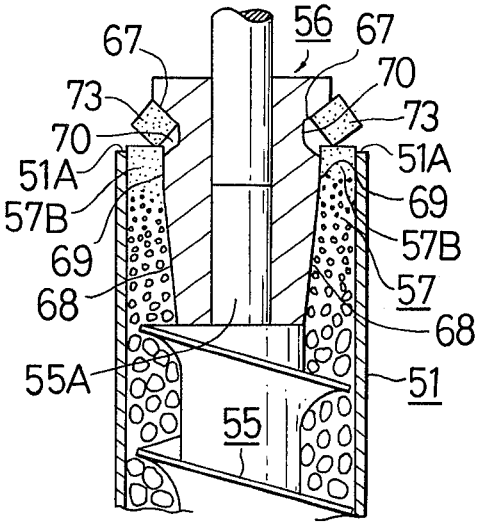
FIG. 5 is a view similar to FIG. 3, illustrating the upper bearing shown in FIG. 4.

Compression passages of a different configuration according to another embodiment will be described with reference to FIGS. 4 and 5. An upper bearing 56 shown in FIGS. 4 and 5 is different from the upper bearing 6 shown in FIGS. 1 through 3 in that the upper bearing 56 has recesses or notches 70 disposed contiguously upwardly of parallel peripheral surfaces 69, and a refrigerated cylinder 51 has an upper opening edge 51A spaced slightly upwardly from an upper edge of the parallel surfaces 69. When compressed ice bars hit ice shearing edges 67, they are broken at the upper opening edge 51A into ice chips 73 of a given shape. The recesses 70 serve as a relief for ice chip corners to enter so that the ice chips will not be damaged. The recesses 70 also free the compresses ice bars as they ascend out of the compression passages with the result that resistance to movement of the ice bars will be reduced and hence the load imposed on an auger 55 will be lessened.

Figure 6:
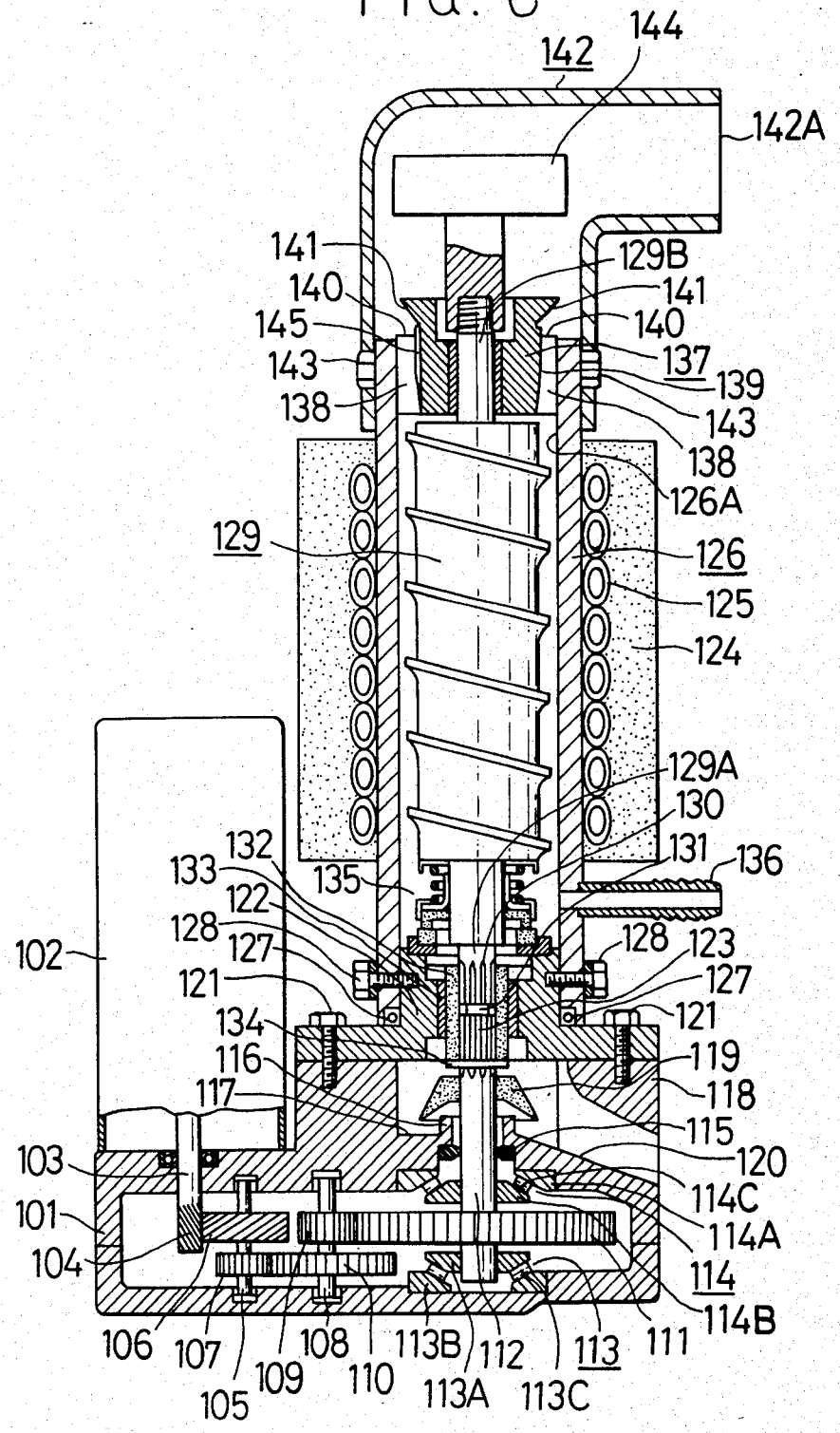
FIG. 6 is a longitudinal cross-sectional view of an auger-type icemaker in accordance with still another embodiment of the present invention.

FIG. 6 is illustrative of an auger-type icemaker according to still another embodiment of the present invention. The auger-type icemaker has a hollow casing 101 which is separable into upper and lower members and a motor (not shown) housed in a motor cover 102 mounted on an upper wall surface of casing 101, the motor having a downwardly extending driving shaft 103 projecting into the casing 101. The driving shaft 103 has on its lower end a first helical gear 104 held in driving mesh with a second helical gear 106 mounted on a first gear shaft 105 rotatably supported on and between the top and bottom walls of the casing 101 and supporting a first small-diameter gear 107 disposed below the second helical gear 106. A second gear shaft 108 is rotatably supported on and between the top and bottom walls of the casing 101 and is spaced from the first gear shaft 105. The second gear shaft 108 supports thereon a second small-diameter gear 109 and a medium-diameter gear 110 mounted below the second small-diameter gear 109 and held in driving mesh with the first small-diameter gear 107. The second small-diameter gear 109 is held in driving mesh with a large-diameter gear 111 mounted on an output shaft 112 rotatably supported by a lower cylindrical roller bearing 113 comprising an upper housing 113A press-fitted over a lower end of the output shaft 112, a lower housing 113B press-fitted in the bottom wall of the casing 101, and rollers 113C interposed between the upper and lower housings 113A, 113B, and by a lower cylindrical roller bearing 114 comprising a lower housing 114B press-fitted over the output shaft 112, an upper housing 114A press-fitted in the top wall of the casing 101, and rollers 114C interposed between the lower and upper housings 114B, 114A. The output shaft 112 has an upper end portion projecting upwardly beyond the casing 101 with an oil seal 115 acting between the output shaft 112 and the casing 101 above the upper cylindrical roller bearing 114. The projecting upper end portion of the output shaft 112 is surrounded by a low wall 116 integral with the casing 101 and a high wall 118 integral with the casing 101 and defining a leakage water drain slot 117 extending around the low wall 116. A conically tapered water drip member 119 is fitted over the output shaft 112 above the low wall 116 and has a circular lower edge directed toward the leakage water drain slot 117. Leakage water which flows down the water drip member 119 into the leakage water drain slot 117 is discharged out through a drain passage 120 extending through the high wall 118 into communication with the leakage water drain slot 117, so that any leakage water will be prevented from entering the casing 101. A hollow support 122 is mounted on the high wall 118 of the casing 101 and fastened thereto by bolts 121. The output shaft 112 has an upper end located within the hollow support 122 and having a plurality of vertical key slots 123.

A refrigerated cylinder 126 has a lower end fitted over the hollow support 122 and is surrounded by a coiled refrigerant evaporation tube 125 covered with a thermally insulating wall 124. The lower end of the refrigerated cylinder 126 is affixed to the hollow support 122 by bolts 128 with an O-ring 127 interposed therebetween. An auger 129 is rotatably mounted in the refrigerated cylinder 26 supported vertically on the support 22 and has a lower shaft 129A provided with a number of axial or vertical key slots 130. Between the confronting ends of the output shaft 112 and the lower shaft 129A of the auger 129, there is interposed a spacer 131 for taking up any dimensional error in the vertical direction which would be produced upon installation of the auger 129 in the refrigerated cylinder 126. The output shaft 112 and the lower shaft 129A of the auger 129 are interconnected by a spline coupling 132 engaging in the key slots 123, 130 within the support 122. The spline coupling 132 has its outer peripheral surface supported by a journal bearing 133 and is prevented from dropping down by a washer 134 fitted over the output shaft 112. A water-resistant mechanical seal 135 is mounted on a lower portion of the refrigerated cylinder 126 and supported on the support 122. Water is supplied from a cistern (not shown) through a water supply tube 136 connected to a lower portion of the refrigerated cylinder 126 into the latter up to a predetermined level therein.

Figure 7:
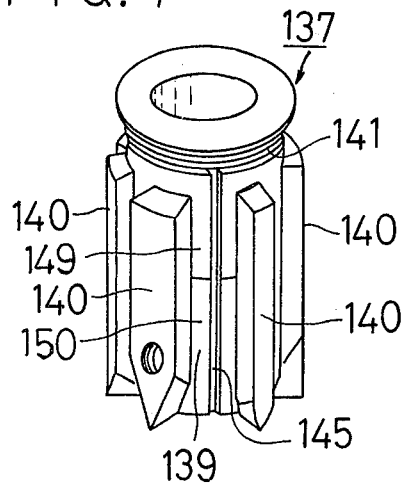
FIG. 7 is a perspective view of an upper bearing used in the auger-type icemaker shown in FIG. 6.

The auger 129 has an upper shaft 129B supported on an upper bearing 137 inserted in the refrigerated cylinder 126. A plurality of ice compression passages 138 are defined between the upper bearing 137 and the inner wall surface of the refrigerated cylinder 126. As shown in FIG. 7, the upper bearing 137 has a total of six radial compression ribs 140 projecting radially outwardly from a peripheral surface thereof at angularly equally spaced locations and having tapered lower ends serving to facilitate entry of scraped ice into the compression passages 138. The upper bearing 129 has an integral ice shearing edge 141 on an upper end of its peripheral surface 139. The peripheral surface 139 of the upper bearing 137 is composed of lower slant surface portions 150 and upper contiguous parallel surface portions 149.

The upper bearing 137 is fitted over the upper shaft 129B of the auger 129 and fastened to the refrigerated cylinder 126 by bolts 143. An L-shaped ice delivery pipe 142 is also joined by the bolts 143 to the refrigerated cylinder 126. With the upper bearing 137 thus installed, its compression ribs 140 are held against the inner wall surface 126A of the refrigerated cylinder 126 and the ice compresstion passages 138 are defined between the inner wall surface 126A, the adjacent compression ribs 140 and the peripheral surface 139 of the upper bearing 137. An agitator 144 is screwed to the end of the upper shaft 129B of the auger 129 and is rotatable with the latter for moving produced ice chips through the ice delivery pipe 142 toward its discharge outlet 142A.

Figure 8:
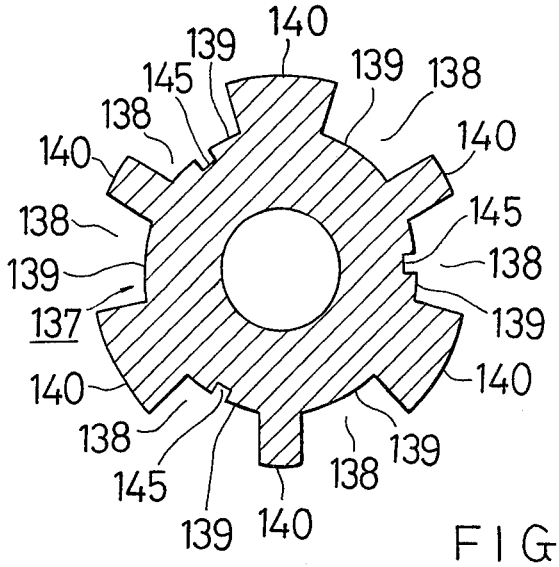
FIG. 8 is a transverse cross-sectional view of the upper bearing illustrated in FIG. 7.

As best shown in FIGS. 7 and 8, an air escape groove 145 is defined in parallel relationship in one of every other compression passages 138 of the upper bearing 137, the air escape groove 145 having an upper end communicating with the exterior of the compression passage 138. As shown in FIG. 8, there are a total of three such air escape grooves 145 defined in the peripheral surface 139 of the upper bearing 137.

The auger-type icemaker thus constructed will operate to produce chip ice and discharge air from the refrigerated cylinder as follows: When the auger-type icemaker starts to operate, a refrigerant flows through the evaporation tube 125 to refrigerate the cylinder 126 for gradually freezing water in the refrigerated cylinder 126 to form ice on the inner wall surface 126A thereof. Rotative power from the motor is transmitted through the first helical gear 104, the second helical gear 106, the first small-diameter gear 107, the medium-diameter gear 110, the second small-diameter gear 109 to the large-diameter gear 111. The speed of rotation is reduced to the extent that the large-diameter gear 111 will rotate about ten and several times per minitue. The rotation of the large-diameter gear 111 is finally transmitted through the output shaft 112 to the auger 129.

Ice grown on the inner wall surface 126A is scraped off by the auger 129 as it rotates and fed upwardly into the ice compression passages 138 in which water is gradually removed from the ice. The ice compression passages 138 are now filled with dry and hardened ice particles. Frictional contact between such ice particles within the ice compression passages 138 prevents the ice particles from entering deeply into the air escape grooves 145 which are thus left hollow. Any air bubbles released from the scraped ice particles find their way into the air escape grooves 145, move upwardly in the latter as the ice particles go up, and are finally discharged out of the compression passages 138 from their upper ends.

While good air discharge capability can be attained by the three air escape grooves 145 defined in the bearing peripheral surface 139 as shown in FIGS. 7 and 8, a different number of air escape grooves may be provided without imparing such good air discharge capability.

Figure 9:
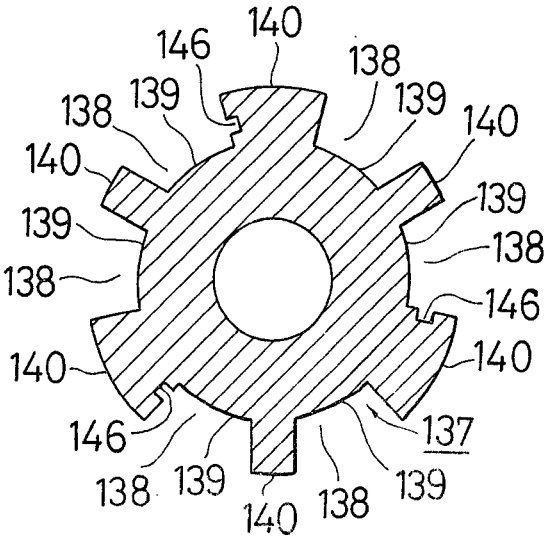
FIG. 9 is a view similar to FIG. 8, showing an upper bearing according to a still further embodiment of the present invention.

According to a still further embodiment of the present invention as shown in FIG. 9, air escape grooves 146 are defined in sidewalls of selected ice compression ribs 140.

With the arrangement of the present invention, the peripheral surface or the compression ribs of the upper bearing has therein air escape grooves extending parallel to the ice compression passages and communicating with the exterior, so that air bubbles freed from ice particles can reliably be discharged away through the air escape grooves and hence the refrigerated cylinder can cool scraped ice sufficiently without interruption which would otherwise be caused by air bubbles trapped in the refrigerated cylinder. Excess refrigeration in the refrigerated cylinder can also be prevented. The auger-type icemaker according to the present invention can thus produce ice chips stably.

The air escape grooves will not impair the desired ice compression function to be performed by the ice compression passages, and also will assist air in moving upwardly and escaping reliably as ice particles ascend in the ice compression passages.

Although certain preferred embodiments have been shown and described, it should be understood that many changes and modifications may be made therein without departing from the scope of the appended claims.

What is claimed is:

1. An icemaker for producing hard chip, shaped ice comprising:

refrigerated cylinder means having an upper end for forming ice on an inner cylindrical surface thereof;

an auger rotatably mounted within said refrigerated cylinder to scrape ice from said inner cylindrical surface and advance same; and bearing means mounted to said cylinder and carrying said auger, said auger advancing said scraped ice thereto, said bearing means having a peripheral surface comprised of an inverted frusto-conical surface extending radially outward and into and contiguous with a cylindrical surface spaced a substantially constant distance from and parallel to said inner cylindrical surface, a plurality of axial ribs projecting outwardly from said peripheral surface into abuttment with said inner cylindrical surface, said frusto-conical surface, said cylindrical bearing surface, said axial ribs, and said inner cylindrical surface comprising passages for compressing and shaping ice therein to form ice chips at said upper open end of said refrigerated cylinder.

2. An auger-type icemaker according to claim 1, wherein said bearing cylindrical surfaces dispose at least up to an upper open end of the refrigerated cylinder.

3. An auger-type icemaker according to claim 2, wherein said peripheral surfaces of said bearing means have recesses extending upwardly contiguously from said cylindrical surface, said upper end of the refrigerated cylinder being positioned slightly upwardly of the upper end of said cylindrical surface.

4. An auger-type icemaker according to claim 1, 2 or 3, wherein said peripheral surfaces of said bearing means include air escape grooves extending substantially parallel to said passages and having upper ends communicating with an exterior of said passages.

5. An auger-type icemaker according to claim 1, 2 or 3, wherein said axial ribs having in side surfaces thereof air escape grooves extending substantially parallel to said passages and having upper ends communicating with an exterior of said passages.

6. An auger-type icemaker according to claim 1, 2 or 3, wherein said axial ribs are composed of a plurality of angularly equally spaced thinner ribs and a plurality of thicker ribs each interposed between adjacent ones of said thinner ribs and extending downwardly beyond said thinner ribs, and thicker ribs having lower end portions of progressively smaller widths.

7. An auger-type icemaker according to claim 4, wherein said axial ribs are composed of a plurality of thinner ribs and thicker ribs which are alternatively disposed and have substantially equal height, said thinner and thicker ribs having lower end portions of progressively smaller widths.

8. An auger-type icemaker according to claim 7, wherein said air escape grooves are disposed centrally in every other peripheral surfaces between adjacent thinner and thicker ribs.

9. An auger-type icemaker according to claim 1, wherein said frusto-conical surface is curved.

10. An auger-type icemaker according to claim 1, wherein said frusto-conical surface is flat.

11. An auger-type icemaker according to claim 1, wherein said cylindrical surface is curved.

12. An auger-type icemaker according to claim 1, wherein said cylindrical surface is flat.

13. The icemaker according to claim 1 wherein said peripheral surface further comprises a shearing edge extending radially outward from said cylindrical bearing surface and displacing away from said refrigerated cylinder upper end in the axial direction.

* * * * *